US007780752B2

(12) United States Patent
Cha et al.

(10) Patent No.: US 7,780,752 B2
(45) Date of Patent: Aug. 24, 2010

(54) CYCLONE DUST-SEPARATING APPARATUS OF VACUUM CLEANER

(75) Inventors: Seung-Yong Cha, Gwangju (KR); Jang-Keun Oh, Gwangju (KR)

(73) Assignee: Samsung Gwangju Electronics co., Ltd, Gwangju (KR)

( * ) Notice: Subject to any disclaimer, the term of this patent is extended or adjusted under 35 U.S.C. 154(b) by 447 days.

(21) Appl. No.: 11/975,295

(22) Filed: Oct. 18, 2007

(65) Prior Publication Data

US 2008/0295466 A1 Dec. 4, 2008

(30) Foreign Application Priority Data

May 28, 2007 (KR) ..... 10-2007-0051385

(51) Int. Cl.
*B01D 45/12* (2006.01)

(52) U.S. Cl. ..... 55/288; 55/299; 55/304; 55/337; 55/459.1; 55/DIG. 3

(58) Field of Classification Search ..... 55/295, 55/296, 299, 337, 429, 459.1, DIG. 3, 288, 55/304
See application file for complete search history.

(56) References Cited

U.S. PATENT DOCUMENTS 5,271,751 A * 12/1993 Lagler ..... 55/295
2007/0017064 A1 1/2007 Gogel et al. ..... 15/352

FOREIGN PATENT DOCUMENTS

| | | |
|---|---|---|
| CH | 254781 | 5/1948 |
| DE | 2102231 | 1/1971 |
| EP | 0388385 | 9/1990 |
| GB | 2389064 | 12/2003 |
| GB | 2428559 | 2/2007 |
| JP | 2006-095062 | 4/2006 |
| JP | 2003310507 | 2/2007 |

OTHER PUBLICATIONS

Office Action dated Dec. 12, 2008 corresponding to Russian Patent Application No. 2008106658.
Office Action dated May 6, 2009 corresponding to Australian Patent Application No. 2008200639.
Extended European Search Report dated Feb. 12, 2010 corresponding to European Patent Application No. 08101479.

* cited by examiner

*Primary Examiner*—Robert A Hopkins
(74) *Attorney, Agent, or Firm*—Ohlandt, Greeley, Ruggiero & Perle, LLP

(57) ABSTRACT

A cyclone dust-separating apparatus of a vacuum cleaner is disclosed. The cyclone dust-separating apparatus includes a cyclone unit having a cyclone chamber to whirl first air drawn in from the outside thus to separate dust or dirt therefrom, a filter unit disposed in a filtering chamber located in a downstream of the cyclone unit and having a filter to filter dust or dirt from the first air, a cleaning unit to brush away the dust or dirt accumulated in the filter by using second air drawn in from the outside, and a dust collecting unit to collect and store the dust or dirt separated from the first air by the cyclone chamber and the dust or dirt brushed away from the filter by the cleaning unit.

9 Claims, 9 Drawing Sheets

CYCLONE DUST-SEPARATING APPARATUS OF VACUUM CLEANER

CROSS-REFERENCE TO RELATED APPLICATIONS

This application claims the benefit under 35 U.S.C. §119 (a) of Korean Patent Application No. 10-2007-0051385, filed on May 28, 2007, in the Korean Intellectual Property Office, the entire content of which is hereby incorporated by reference.

BACKGROUND OF THE INVENTION

1. Field of the Invention

The present disclosure relates to a vacuum cleaner. More particularly, the present disclosure relates to a cyclone dust-separating apparatus of a vacuum cleaner, which draws in an external air and then separates dust or dirt therefrom.

2. Description of the Related Art

In general, a cyclone dust-separating apparatus provided in a vacuum cleaner is an apparatus, which whirls air laden with dirt or dust and thus separates the dirt or dust therefrom. Such a cyclone dust-separating apparatus has been recently widely used because it can be semi-permanently used without any inconvenience of frequently replacing dust bags.

The cyclone dust-separating apparatus usually includes a cyclone unit to make drawn-in air into a whirling current and thus to separate dust or dirt from the drawn-in air, an inflow pipe to guide the drawn-in air to flow into the cyclone unit in a tangential direction thereof, and a dust collecting unit to collect and store the separated dust or dirt therein. The cyclone dust-separating apparatus as described above separates all of large dust or dirt, medium dust or dirt, and minute dust or dirt from the drawn-in air at once. Accordingly, relatively large and heavy dust or dirt can be easily filtered, but relatively minute dust or dirt, such as particles, are apt to be discharged through an outflow pipe as mixed with the air. As a result, the conventional cyclone dust-separating apparatus presents a problem that a dust-separating efficiency is deteriorated.

To address the problem as described above, recently, a cyclone dust-separating apparatus in which a filter unit is installed between a cyclone unit and an outflow pipe has been proposed and used. Since such a cyclone dust-separating apparatus does not discharge air through the outflow pipe directly after dust or dirt is separated from the air by the cyclone unit, but secondly filters minute dust or dirt from the air through the filter unit, it can separate even the minute dust or dirt, such as particles or the like. As a result, a dust separating efficiency is improved. However, this cyclone dust-separating apparatus may present a problem that if the filter unit is choked due to the minute dust or dirt accumulated therein, a suction force is deteriorated and thereby the dust separating efficiency is reduced. Accordingly, there is a need for a user to carry out a troublesome task of disassembling the cyclone dust-separating apparatus to clean the filter unit on occasion.

To address the problems as described above, a vacuum cleaner having a filter cleaning system capable of automatically cleaning a filter is actively developing.

As an example of such a vacuum cleaner, a vacuum cleaner having a filter cleaning system in which a rotation bar with a flap coming in contact with a filter is installed in the vicinity of a filter unit is disclosed in U.S. Patent publication 2007-17064. The filter cleaning system of the vacuum cleaner rotates the rotation bar with a motor to brush off dust or dirt from the filter. Since this vacuum cleaner can automatically clean the filter, there is no need for the user to carry out the troublesome task of disassembling the cyclone dust-separating apparatus to clean the filter unit on occasion. However, since the rotation bar is driven by the motor, a problem occurs, in that fabrication costs are increased.

As another example, an electric cleaner, which brushes off dust or dirt from a dust bag by using external air, is disclosed in Japanese patent publication 2006-95062. In the electric cleaner, as a filter, a cyclone dust separating apparatus is not used, but the dust bag is used. Also, the electric cleaner rotates a fan by using the external air drawn in through a member for selectively drawing in the external air, and transmits a rotating force of the fan to a rapping plate through gears to brush off the dust or dirt from the dust bag. However, in the dust bag rapping mode, the electric cleaner as described above does not block or close an air passage that the external air moves through the dust bag from a suction nozzle. Accordingly, a suction force of a suction motor is divided into two air passages, and as a result, a cleaning efficiency for the dust bag is deteriorated.

SUMMARY OF THE INVENTION

An aspect of the present disclosure is to address at least the above problems and/or disadvantages and to provide at least the advantages described below. Accordingly, an aspect of the present disclosure is to provide a cyclone dust-separating apparatus of a vacuum cleaner capable of automatically cleaning dust or dirt collected in a filter unit without using external power.

Another aspect of the present disclosure is to provide a cyclone dust-separating apparatus of a vacuum cleaner, which in a filter cleaning mode, cleans the filter while closing an air passage for moving air drawn in through a suction nozzle via the filter, thereby improving a filter cleaning efficiency.

In accordance with an aspect of the present disclosure, a cyclone dust-separating apparatus of a vacuum cleaner includes a cyclone unit having a cyclone chamber to whirl first air drawn in from the outside thus to separate dust or dirt therefrom, a filter unit disposed in a filtering chamber located downstream of the cyclone unit and having a filter to filter dust or dirt from the first air, a cleaning unit to brush away the dust or dirt accumulated in the filter by using second air drawn in from the outside, and a dust collecting unit to collect and store the dust or dirt separated from the first air by the cyclone chamber and the dust or dirt brushed away from the filter by the cleaning unit.

Here, the filter may be a pleated annular filter.

Preferably, but not necessarily, in a filter cleaning mode, the cleaning unit brushes away the dust or dirt accumulated in the filter by using the second air while closing an air passage that the first air drawn in through a suction nozzle of the vacuum cleaner moves via the cyclone unit and the filter unit.

The cleaning unit may include a filter brushing part to brush away the dust or dirt from the filter, a driving part to drive the filter brushing part by the second air, and an air passage changing part to change an air passage to allow the second air to drive the driving part in a filter cleaning mode. Preferably, but not necessarily, the filter brushing part includes a rim member having at least one spoke, supported on a supporting axis rotatably installed in a supporting sleeve around which the filter is fixed, and a plurality of ribs movably and elastically supported on the rim member to come in contact with the filter thus to brush away the dust or dirt from the filter when the rim member is rotated. Preferably, but not necessarily, the driving part includes at least one fan disposed to be rotated by the second air, a worm formed on an axis of the fan, and a worm gear formed on the supporting axis to engage with the worm. Also, the air passage changing part may include an air passage changing valve, and the air passage changing valve may be disposed among a cover, an air discharging guide to discharge the first air past the filter unit and an outflow pipe to discharge the first air to the outside from the air discharging guide, the cover being disposed over the filter unit and having at least one air inlet for drawing in the second air. At this time, preferably, but not necessarily, the air passage switching valve includes an outer body extended to a bottom surface of the air discharging guide through a penetrated opening of an upper surface of the air discharging guide from the cover, and comprising an upper part having first and second upper openings formed to oppose to each other and to be perpendicular to an air flowing direction, and a lower part having first and second lower openings formed to oppose to each other in the air flowing direction; an inner body rotatably inserted in the outer body, and including an upper part having first and second upper openings formed to oppose to each other, and a lower part having first and second lower openings formed to oppose to each other and a third lower opening located in a position apart from the first or the second lower opening by an angle of 90 degrees; and a knob formed on the inner body to rotate the inner body.

The dust collecting unit may include a first dust collecting chamber disposed around the cyclone chamber to collect and store the dust or dirt separated from the first air by the cyclone chamber, and a plurality of second dust collecting chambers to collect and store the dust or dirt brushed away from the filter. At this time, the cleaning unit may further include a dust discharge introducing part to introduce the dust or dirt brushed away from the filter to move to the second dust collecting chambers without being adhered to the filter again. Preferably, but not necessarily, the dust discharge introducing part includes a multi-rim member having a plurality of spokes, fixed on the supporting axis, and a brush attached to the spokes of the multi-rim member to come in contact with a partition plate defining the filtering chamber thus to introduce the brushed-away dust or dirt into the second dust collecting chambers.

BRIEF DESCRIPTION OF THE DRAWING FIGURES

The above and other objects, features, and advantages of certain exemplary embodiment of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a cyclone dust-separating apparatus of a vacuum cleaner according to certain exemplary embodiment of the present disclosure will be described in detail with reference to the accompanying drawing figures.

Figure 1:
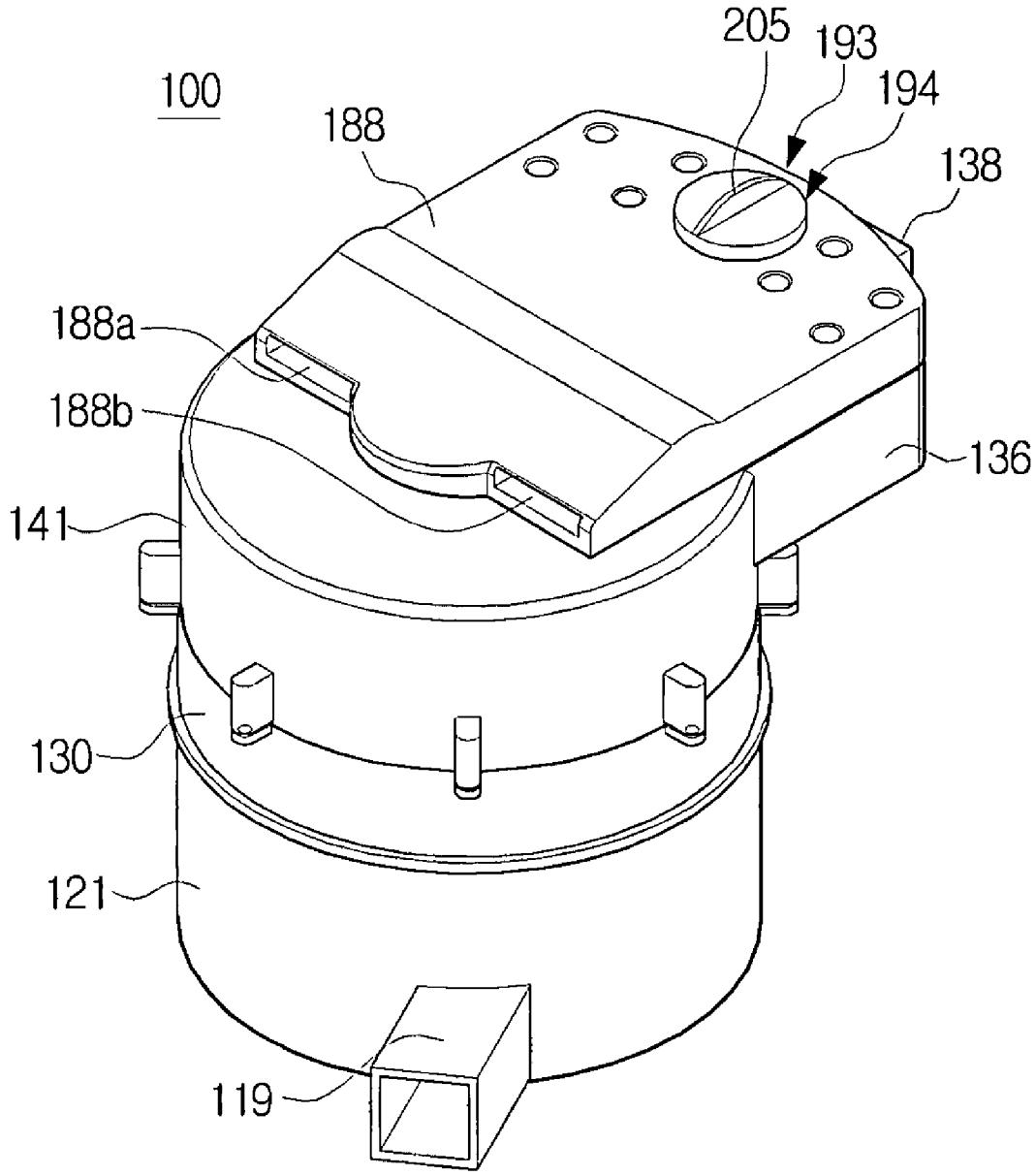
FIG. 1 is a perspective view exemplifying a cyclone dust-separating apparatus of a vacuum cleaner according to an exemplary embodiment of the present disclosure.
Figure 2:
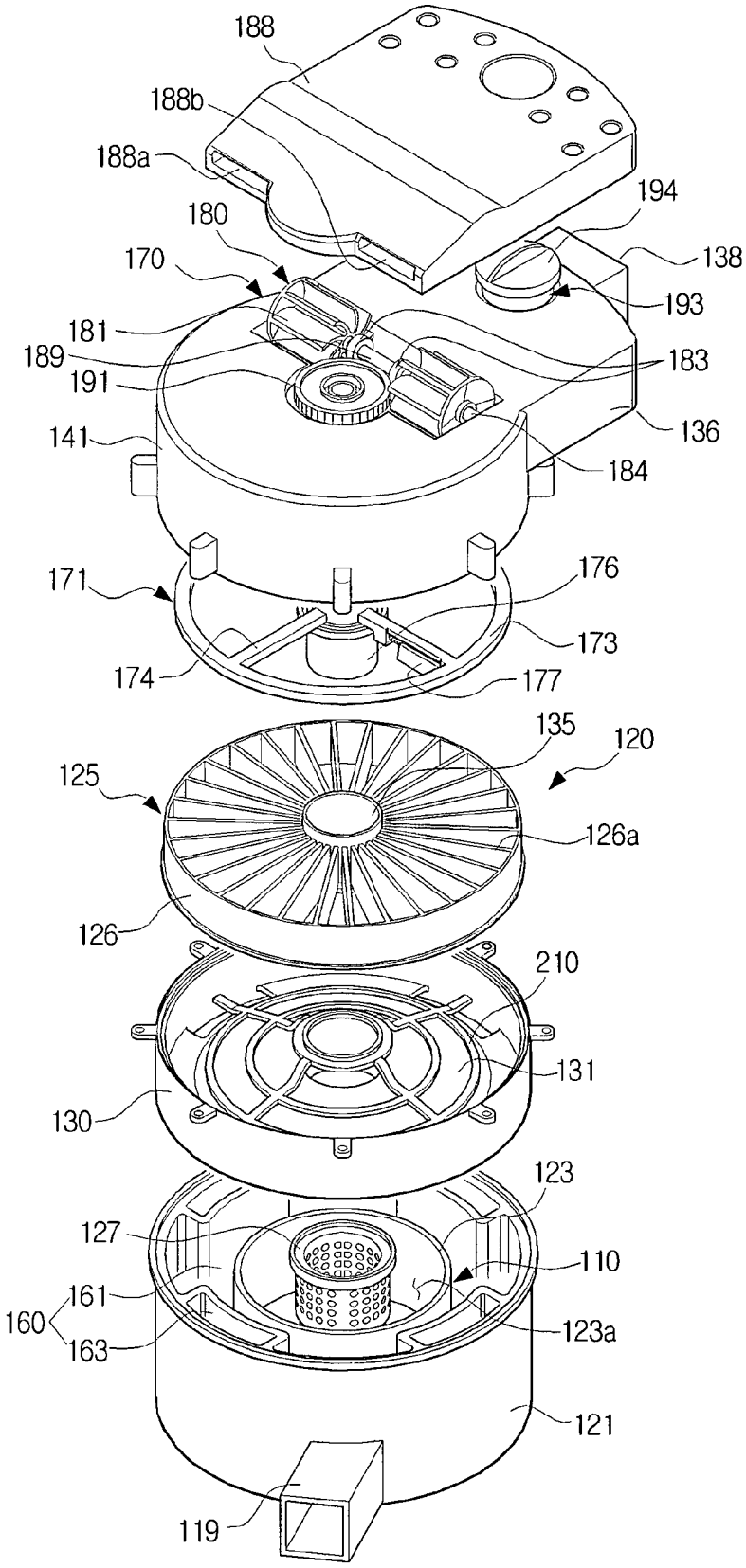
FIG. 2 is an exploded perspective view of the cyclone dust-separating apparatus illustrated in FIG. 1.

FIGS. 1 and 2 are a perspective view and an exploded perspective view exemplifying a cyclone dust-separating apparatus of a vacuum cleaner according to an exemplary embodiment of the present disclosure.

Referring to FIGS. 1 and 2, the cyclone dust-separating apparatus 100 according to the exemplary embodiment of the present disclosure includes a cyclone unit 110, a filter unit 120, a cleaning unit 170, and a dust collecting unit 160.

The cyclone unit 110 is provided with a cyclone body 123, a guide member 124 (see FIG. 3), and a grill member 127.

The cyclone body 123 is installed in a cyclone casing 121, so that it forms a cyclone chamber 123*a*, which whirls first air drawn in from the outside to firstly separate dust or dirt from the first air. The cyclone body 123 at an upper part thereof is opened. The guide member 124 and the grill member 127 are disposed in the cyclone body 123.

An inflow pipe 119 draws in the first air laden with the dust or dirt into the cyclone body 123. For this, the inflow pipe 119, which is connected to a suction nozzle (not illustrated), is extended to one side of a lower part of the cyclone body 123 from one side of a lower part of the cyclone casing 121. Preferably, but not necessarily, the inflow pipe 119 is formed in a shape that allows the first air to be guided into the cyclone body 123 while coming in contact with an inner circumferential surface of the cyclone body 123 after passing through a space between the cyclone casing 121 and the cyclone body 123, that is, a first dust collecting chamber 161 of the dust collecting unit 160 to be described later. The cyclone casing 121 forms an appearance of the cyclone dust-separating apparatus 100, and is formed in an approximately cylinder shape.

Figure 3:
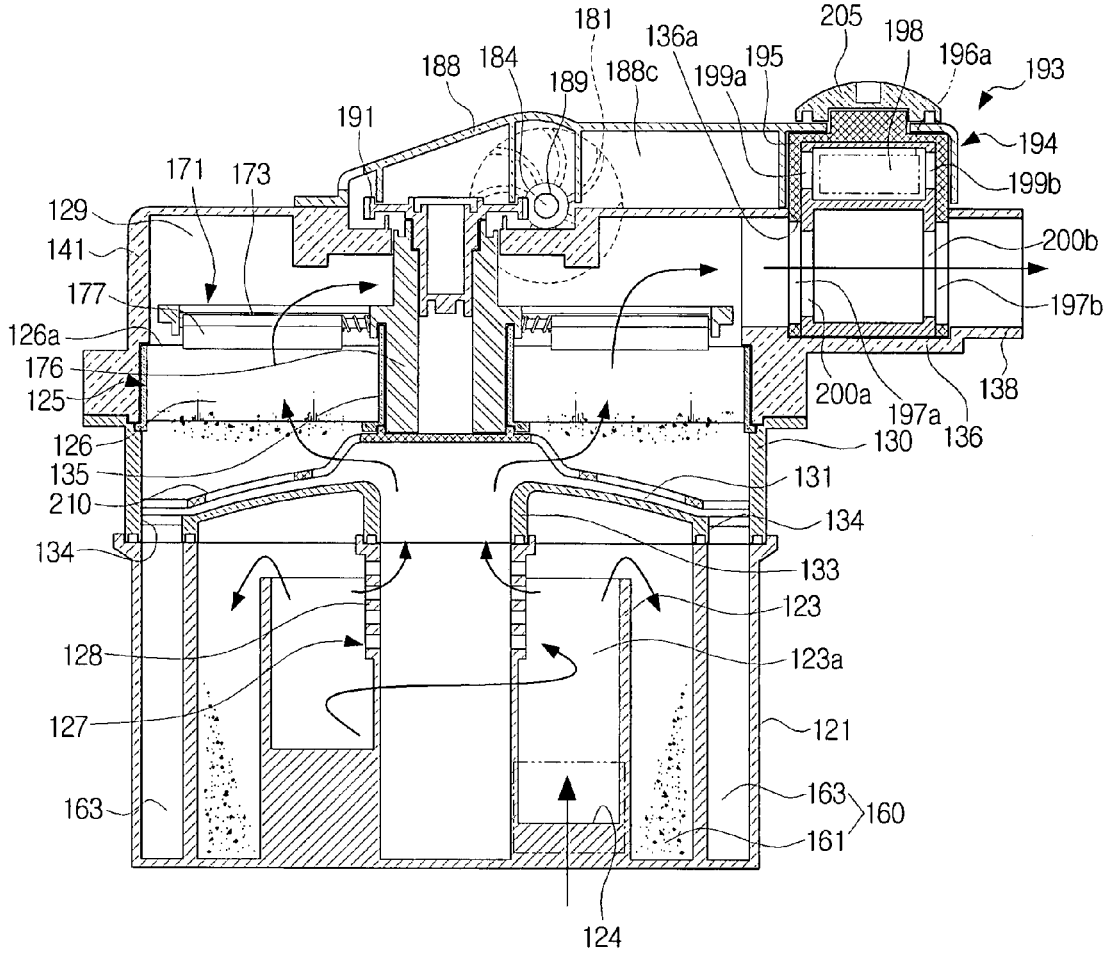
FIG. 3 is a cross-sectional view exemplifying a vacuum cleaning operation of the cyclone dust-separating apparatus illustrated in FIG. 1.
Figure 4:
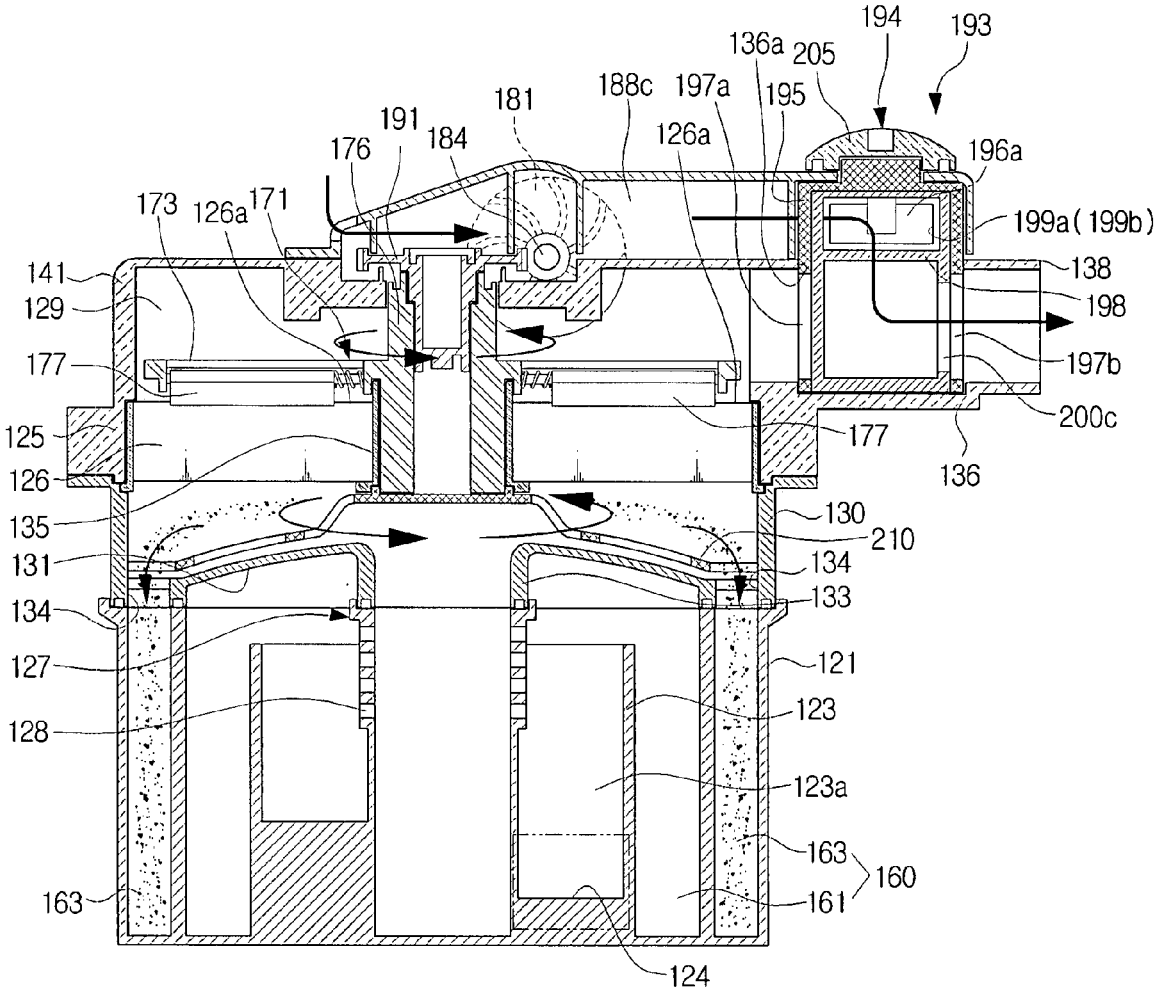
FIG. 4 is a cross-sectional view exemplifying a filter cleaning operation of the cyclone dust-separating apparatus illustrated in FIG. 1.

As illustrated in FIGS. 3 and 4, the guide member 124 functions to guide the first air drawn into the cyclone body 123 to move up while whirling in a spiral direction and thus to allow relatively large dust or dirt included in the first air to move into the first dust collecting chamber 161 of the dust collecting unit 160 across an upper part of the cyclone body 123 along the inner circumferential surface of the cyclone body 123 due to a centrifugal force. For this, the guide member 124 is provided with a spiral guide surface formed along the inner circumferential surface of the cyclone body 123.

The grill member 127 is joined to an upper part of the guide member 124. The grill member 127 draws in the first air laden with minute dust or dirt, which is not separated from the first air by the guide member 124, but remained in the first air, and guides it to the filtering chamber 129. The grill member 127 is provided with a grill body 128 with a plurality of minute through-holes. The grill body 128 at a top end thereof is opened, and has a cylinder shape. The top end of the grill body 128 is joined to an air guide opening 133 of a partition plate 131.

Figure 5A:
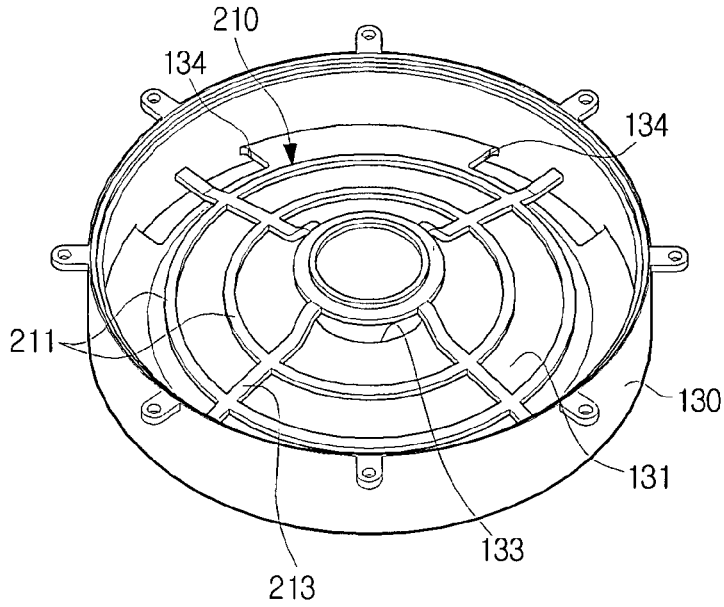
FIGS. 5A and 5B are a perspective view and a cross-sectional view exemplifying constructions of a partition plate casing and a dust discharge introducing part of the cyclone dust-separating apparatus illustrated in FIG. 2.
Figure 5B:
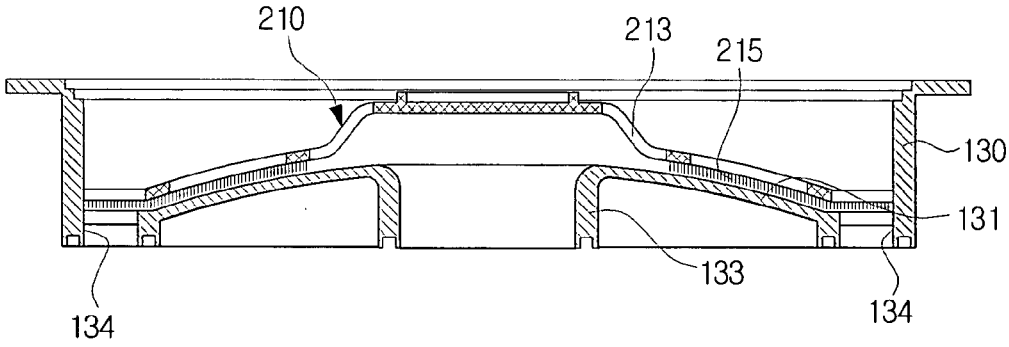

Referring to FIGS. 5A and 5B, the partition plate 131 is integrally formed with a partition plate casing 130 in the form of a cylinder shape at a lower part of the partition plate casing 130. The partition plate casing 130 is joined to an upper part of the cyclone casing 121. The partition plate 131 defines the cyclone chamber 123*a* and the filtering chamber 129. In the middle of the partition plate 131 is formed the air guide opening 133, which is joined with the top end of the grill body 128. In a peripheral edge of the partition plate 131 are formed four dust discharging openings 134, which discharge the dust or dirt in the filtering chamber 129 to four second dust collecting chambers 163 of the dust collecting unit 160 to be described later.

Referring again to FIGS. 1 and 2, the filter unit 120 is provided with a filter casing 141 and a filter 125. The filter casing 141 is formed in a cylinder shape, and joined to an upper part of the partition plate casing 130. As illustrated in FIGS. 3 and 4, the filter casing 141 along with the partition plate casing 130 forms the filtering chamber 129. The filter 125 is formed of a pleated annular filter 126, and is fixed in a lower part of the filter casing 141. The filter 125 secondly filters minute dust or dirt, which is not separated from the first air by the cyclone chamber 123*a*, but remained in the first air.

An air discharging guide 136 is integrally formed with the filter casing 141 on one side of an upper part of the filter casing 141. The air discharging guide 136 is provided with an outflow pipe 138 to discharge the first air past the filter 125 in the filtering chamber 129. A suction motor (not illustrated) of the vacuum cleaner, which provides a suction force, is directly or indirectly connected to the outflow pipe 138. In the vicinity of the outflow pipe 138 of the air discharging guide 136 is disposed an air passage changing part 193, which will be described.

The cleaning unit 170, which brushes away the dust or dirt accumulated in the filter by using a second air in a filter cleaning mode, includes a filter brushing part 171, a driving part 180 and an air passage changing part 193.

Figure 6A:
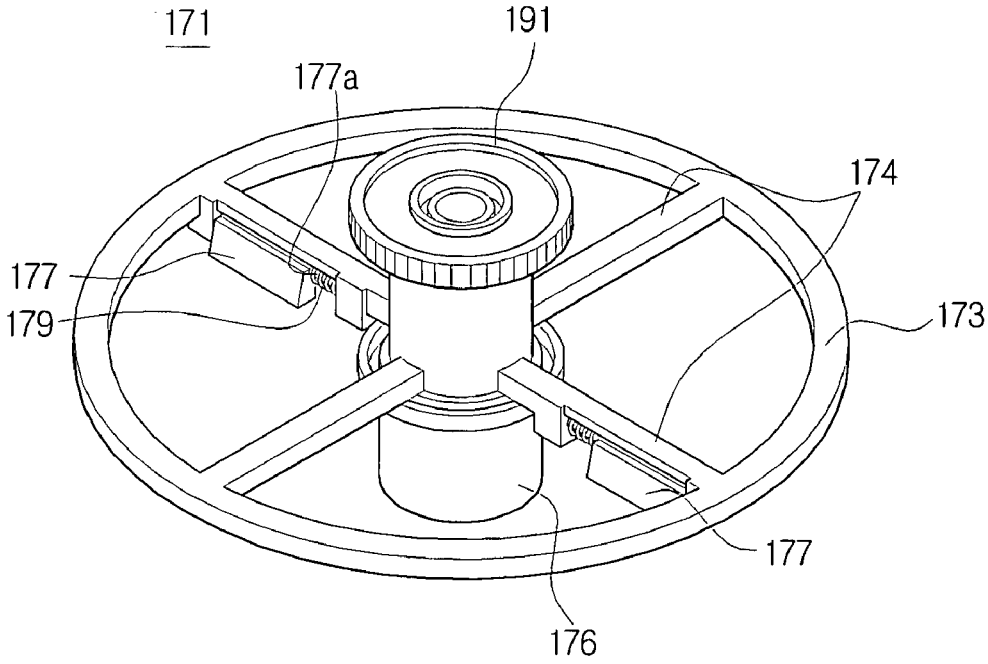
FIGS. 6A and 6B are a perspective view and a side elevation view exemplifying a construction of a filter brushing part of the cyclone dust-separating apparatus illustrated in FIG. 2.
Figure 6B:
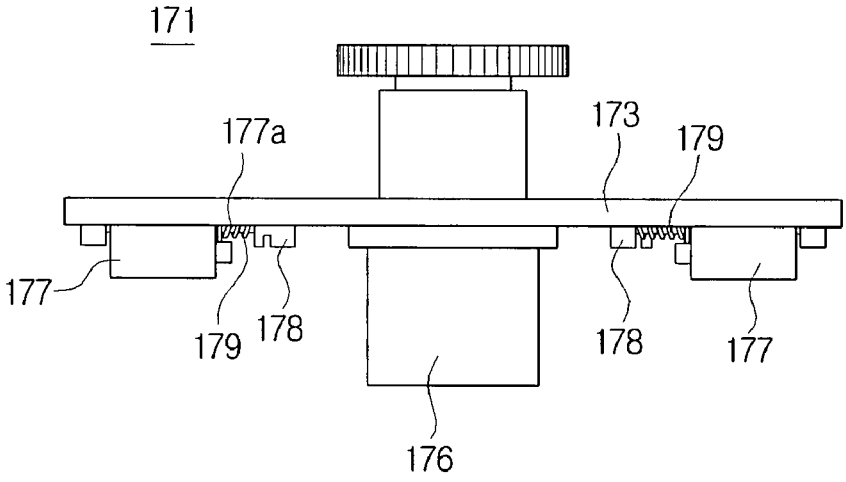
Figure 7:
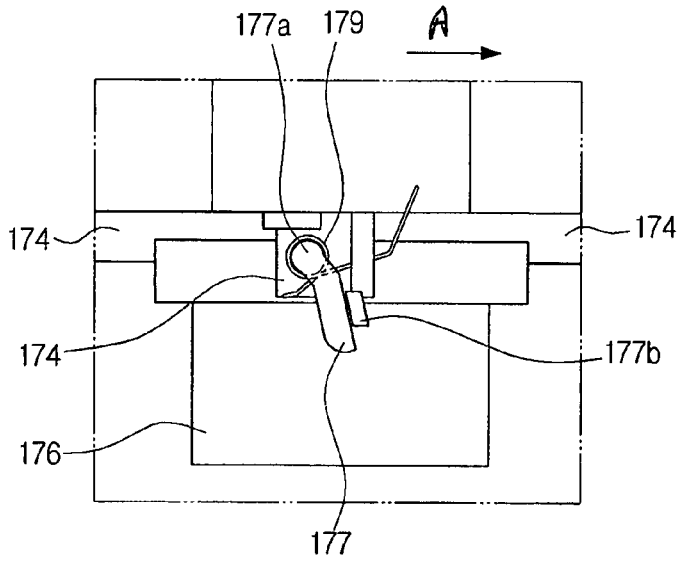
FIG. 7 is a partial side elevation view exemplifying a rib of a rim member of the filter brushing part illustrated in FIGS. 6A and 6B.

As illustrated in FIGS. 6A and 6B, the filter brushing part 171 is provided with a rim member 173 having at least one, for example, four radially arranged spokes 174. The rim member 173 is fixed on a supporting axis 176 rotatably installed in a supporting sleeve 135 around which the filter 125 is fixed, so that it is rotated along with the supporting axis 176. Under two spokes 174 of the rim member 173 are movably and elastically disposed two ribs 177, each of which come in contact with a filter surface 126*a* of the pleated annular filter 126 to brush away the dust or dirt from the filter surface 126*a* when the rim member 173 is rotated by the driving part 180. As illustrated in FIG. 7, each of the ribs 177 is formed in the form of a plate, and on both ends of an upper part thereof are formed hinge axes 177*a*. The hinge axes 177*a* are rotatably supported in hinge holes (not illustrated) of a fixing bracket 178. To movably and elastically support the ribs 177, on the hinge axis 177*a* are installed elastic springs 179, such as torsion springs. Each of the elastic springs 179 at one end thereof is fixed to the spoke 174 and at the other end thereof, fixed to the rib 177, so that the corresponding rib 177 is maintained in a standby position where a stopper 177*b* thereof is pressed against an undersurface of the spoke 174 while coming in contact therewith. Accordingly, when the rim member 173 is rotated in one direction, for example, a counterclockwise direction (a direction of arrow A in FIG. 7), each of the ribs 177 repeats movements that it is pushed in a clockwise direction about the hinge axes 177*a* and then returned to the standby position, and thus brushes the dust or dirt, such as particles or the like, accumulated in the filter surface 126*a*.

Figure 8:
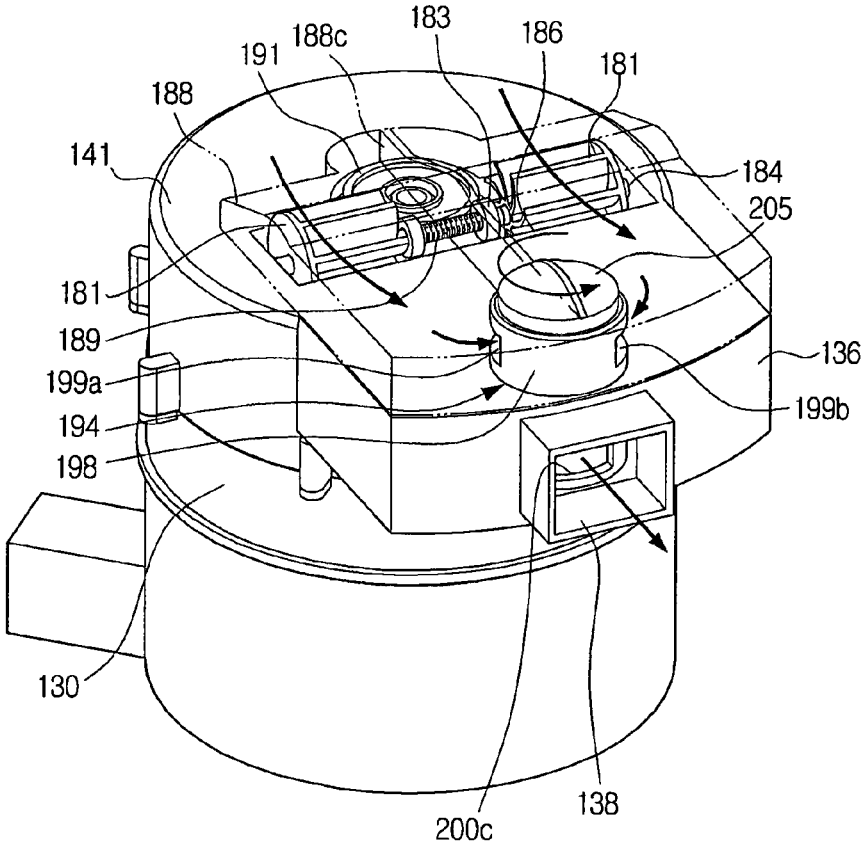
FIG. 8 is a partial perspective view exemplifying an operation of an air passage changing valve of the cyclone dust-separating apparatus illustrated in FIG. 4.

Referring to FIGS. 2, 4 and 8, the driving part 180, which drives and thus rotates the rim member 173 of the filter brushing part 171 by the second air, is provided with two fans 181. The fans 181 are fixed on both ends of an axis 184, which are rotatably supported by two bearings 183. Each of the fans 181 is installed, so that a half thereof is inserted into a mounting space 186 formed in an upper surface of the filter casing 141. The fans 181 are rotated by the second air, which is drawn in through air inlets 188*a* and 188*b* of a cover 188 disposed over the filter casing 141. As illustrate in FIGS. 3 and 8, the cover 188 is divided into two air flowing spaces, each of in which the second air is flowed via the corresponding fan 181, by a partition 188*c*. On the axis 184 between the two bearings 183 is formed a worm 189. The worm 189 is engaged with a worm gear 191 installed on the supporting axis 176 of the rim member 173. At this time, gear teeth of the worm 189 and the worm gear 191 are formed, so that when the fans 181 are rotated by the second air, the supporting axis 176 of the rim member 173 is rotated in the counterclockwise direction of FIG. 6A (the direction of arrow A in FIG. 7).

Accordingly, if the fans 181 are rotated by the second air, the axis 184, which fixes the fans 181, is rotated. As the axis 184 is rotated, the worm 189 and the worm gear 191 are rotated and thus the rim member 173 formed on the supporting axis 176 is rotated in the counterclockwise direction. As a result, the ribs 177 of the rim member 173 brushes away the dust or dirt accumulated in the filter surface 126*a* while coming in contact with the filter surface 126*a* of the pleated annular filter 126.

The air passage changing part 193, which changes an air passage to allow the second air to drive the driving part 180 in a filter cleaning mode, is made up of an air passage changing valve 194.

Figure 9A:
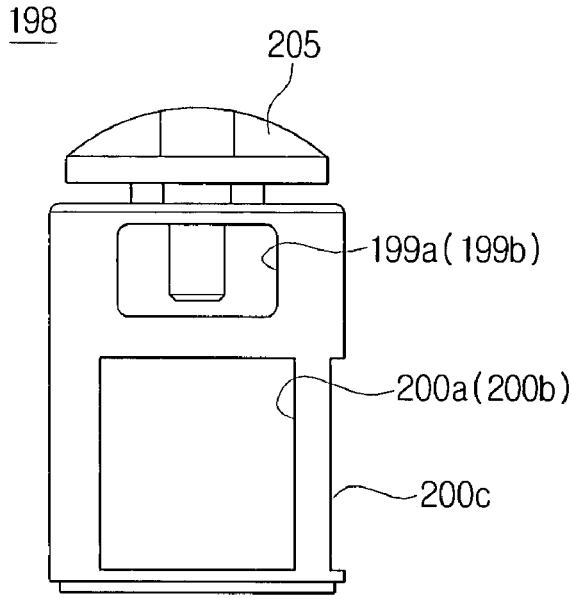
FIGS. 9A and 9B are side elevation views exemplifying a construction of an inner body of the air passage changing valve of the cyclone dust-separating apparatus illustrated in FIG. 2.
Figure 9B:
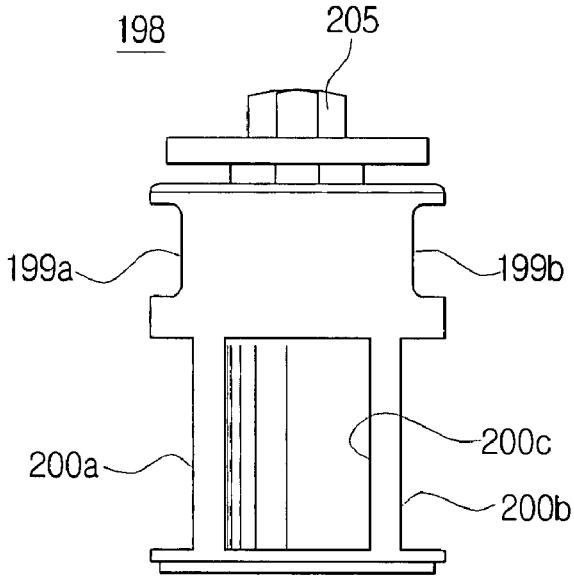

As illustrated in FIG. 8, the air passage changing valve 194 is disposed among the two air flowing spaces of the cover 188, the air discharging guide 136 and the outflow pipe 138 of the air discharging guide 136. As illustrated in FIGS. 3 and 4, the air passage changing valve 194 includes outer and inner bodies 195 and 198 in the form of cylinder. The outer body 195 is extended to a bottom surface of the air discharging guide 136 through a penetrated opening 136*a* of an upper surface of the air discharging guide 136 from the inside of the cover 188. An upper part of the outer body 195 located in the cover 188 has first and second upper openings 196*a* (one illustrated in FIG. 4) formed to oppose to each other and to be perpendicular to an air flowing direction, whereas a lower part of the outer body 195 located in the air discharging guide 136 has first and second lower openings 197*a* and 197*b* formed to oppose to each other in the air flowing direction. As illustrated in FIGS. 9A and 9B, the inner body 198 is rotatably inserted in the outer body 195, and has a knob 205 formed at an upper part thereof. An upper part of the inner body 198 has first and second upper openings 199*a* and 199*b* formed to oppose to each other, and a lower part of the inner body 198 has first and second lower openings 200*a* and 200*b* formed to oppose to each other and a third lower opening 200*c* located in a position apart from the first or the second lower opening 200*a* or 200*b* by an angle of approximate 90 degrees.

Accordingly, as illustrated in FIGS. 4 and 8, if to carry out the filter cleaning mode, a user rotates the knob 205 in a filter cleaning position where the first and the second upper openings 199*a* and 199*b* and the third lower opening 200*c* of the inner body 198 are communicated with the first and the second upper openings 196*a* and the second lower opening 197*b* of the outer body 195, the second air is drawn in through the air inlets 188*a* and 188*b* of the cover 188 by the suction force of the suction motor, moved via the fans 181 of the driving part 180, and then is discharged through the outflow pipe 138 via the air passage changing valve 194. At this time, since the first lower openings 197*a* of the outer body 195 of the air passage changing valve 194 is blocked by the inner body 198, the first air is not drawn in through the inflow pipe 119 of the cyclone casing 121.

To the contrary, as illustrated in FIG. 3, if to carry out the vacuum cleaning mode, the user rotates the knob 205 in a vacuum cleaning position where the first and the second lower openings 200*a* and 200*b* of the inner body 198 are communicated with the first and the second lower openings 197*a* and 197*b* of the outer body 195, the first air is drawn in through the inflow pipe 119 of the cyclone casing 121 by the suction force of the suction motor, moved via the cyclone unit 110 and the filter unit 120, and then is discharged through the outflow pipe 138 via the air passage changing valve 194. At this time, since the first and the second upper openings 196*a* of the outer body 195 of the air passage changing valve 194 is blocked by the inner body 198, the second air is not drawn in through the air inlets 188*a* and 188*b* of the cover 188.

As described above, in the filter cleaning mode, the air passage changing valve 194 of the air passage changing part 193 closes the air passage that the first air is drawn in through the inflow pipe 119 connected with the suction nozzle and then moved via the cyclone unit 110 and the filter unit 120, and opens the air passage that the second air is drawn in through the air inlets 188*a* and 188*b* of the cover 188 and then moved via the fans 181 of the driving part 180. Accordingly, the suction force of the suction motor is applied to the latter air passage. As a result, a rotating force of the fans 181 of the driving part 180 is enlarged, thereby improving a cleaning efficiency.

Figure 10:
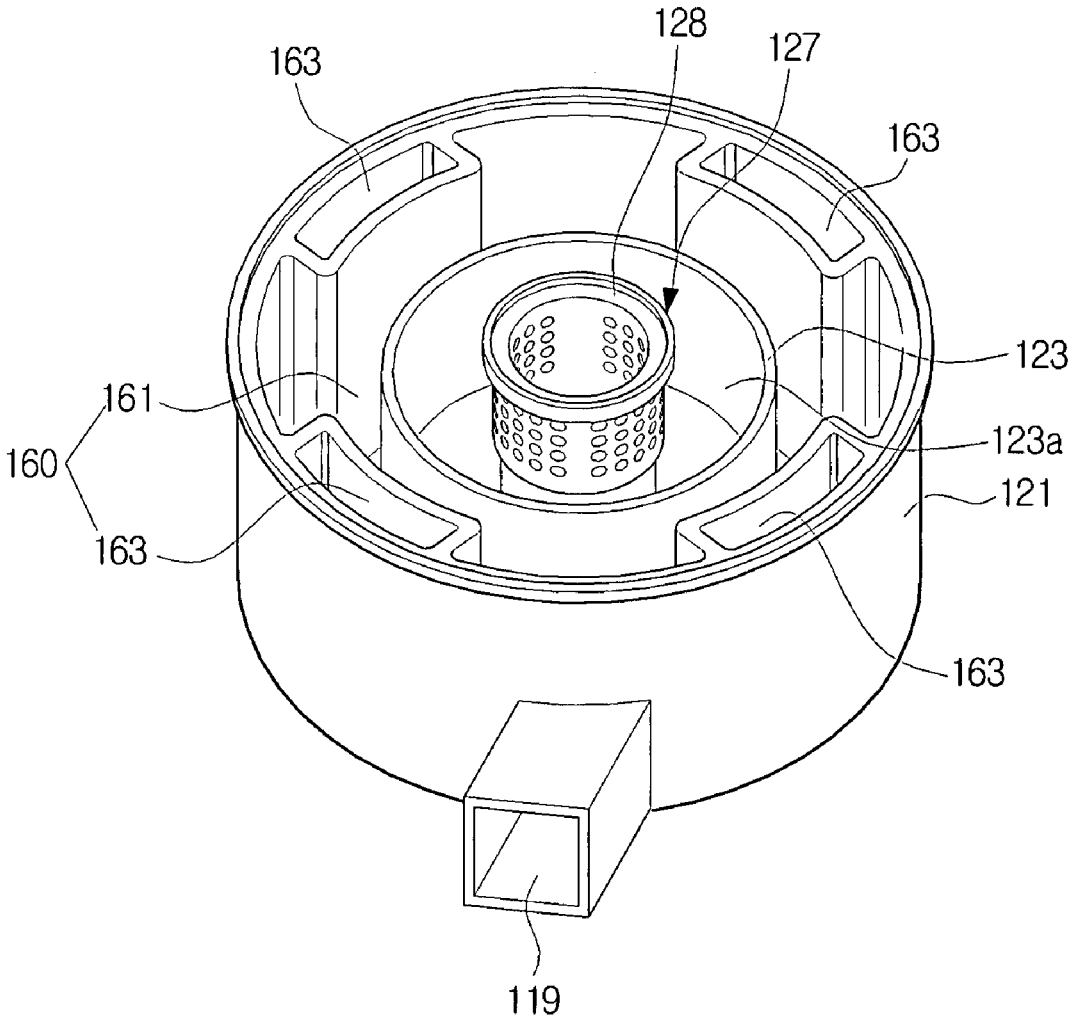
FIG. 10 is a perspective view exemplifying constructions of a cyclone unit and a dust collecting unit of the cyclone dust-separating apparatus illustrated in FIG. 2.

Referring to FIGS. 2 and 10, the dust collecting unit 160 collects and stores the dust or dirt centrifugally separated from the first air by the cyclone chamber 123*a* and the dust or dirt brushed away from the filter 125 by the cleaning unit 170. For this, the dust collecting unit 160 is provided with a first dust collecting chamber 161 and four second dust collecting chambers 163. The first dust collecting chamber 161 is disposed around the cyclone chamber 123, and has a cylindrical structure, an upper end of which is defined by the partition plate 131 and a lower end of which is defined by the cyclone casing 121. The first dust collecting chamber 161 collects and stores the dust or dirt separated from the first air by the cyclone chamber 123*a*. The second dust collecting chambers 163 are made up of four second dust collecting chambers 163, which are arranged in intervals of approximate 90 degrees inside the cyclone casing 121. As illustrated in FIGS. 3 and 4, the second dust collecting chambers 163 are connected with the dust discharging openings 134 (see FIG. 5A) of the partition plate 131, respectively. The second dust collecting chambers 163 collect and store the dust or dirt, which is brushed away from the filter 125 by the cleaning unit 170 and discharged through the dust discharging openings 134.

At this time, as illustrated in FIGS. 5A and 5B, to introduce the dust or dirt brushed away from the filter 125 by the ribs 177 of the filter brushing part 171 to move to the second dust collecting chambers 163 without being adhered to the filter 125 again, the cleaning unit 170 can further include a dust discharge introducing part 210.

The dust discharge introducing part 210 includes a multi-rim member 211 having four spokes 213. The multi-rim member 211 is fixed on a lower part of the supporting axis 176 of the rim member 177. As illustrated in FIG. 5B, a brush 215 is attached to undersurfaces of the spokes 213 of the multi-rim member 211. When the rim member 211 is rotated, the brush 215 comes in contact with an upper surface of the partition plate 131 thus to brush away the dust or dirt accumulated on the upper surface of the partition plate 131 and to introduce the brushed-away dust or dirt into the dust discharging openings 134.

Hereinafter, an operation of the cyclone dust-separating apparatus 100 according to the exemplary embodiment of the present disclosure as described above will now be explained in detail with reference to FIGS. 1 through 10.

First, assuming that the operating mode of the vacuum cleaner is a vacuum cleaning mode, which cleans a surface to be cleaned, the knob 205 of the air passage changing valve 194 is positioned in the vacuum cleaning position, as illustrated in FIG. 3. In this position, the first and the second upper openings 196*a* of the outer body 195 of the air passage changing valve 194 is blocked by the inner body 198.

Under this state, if the suction motor of the vacuum cleaner is operated, first external air laden with dust or dirt is flowed into the cyclone chamber 123*a* in the cyclone body 123 through the inflow pipe 119. The flowed-in first air is induced to a whirling current by the guide member 124. Due to a centrifugal force of the whirling current, relatively large dust or dirt included in the first air raises over the cyclone chamber 123*a* and then falls down into the first dust collecting chamber 161 of the dust collecting unit 160. As a result, the relatively large dust or dirt is collected and stored in the first dust collecting chamber 161.

And, the dust-removed first air passes through the grill member 127, moves up through the air guide opening 133 of the partition plate 131, and flows into the filtering chamber 129. The first air flowed into the filtering chamber 129 keeps moving up, so that minute dust or dirt is secondly filtered by the filter 125. The dust-filtered first air moves to the air discharging guide 136 and discharges through the outflow pipes 138 via the air passage changing valve 194.

After the vacuum cleaning mode is completed as described above, if the user wants to clean the dust or dirt accumulated in the filter 125, she or he changes a position of the knob 205 to the filter cleaning position illustrated in FIGS. 4 and 8. In this position, the first lower openings 197*a* of the outer body 195 of the air changing valve 194 is blocked by the inner body 198.

Under this state, if the suction motor of the vacuum cleaner is operated, second external air is drawn into the air flowing spaces of the cover 188 through the air inlets 188*a* and 188*b* of the cover 188. The second air drawn into the air flowing spaces of the cover 188 rotates the fans 181 while passing through the fans 181, and discharges through the outflow pipe 138 via the air passage changing valve 194.

As the fans 181 are rotated as described above, the axis 184, which fixes the fans 181, is rotated, as illustrated in FIG. 8. As the axis 184 is rotated, the worm 189 and the worm gear 191 are rotated and thus the rim member 173 formed on the supporting axis 176 is rotated in a counterclockwise direction. As a result, the ribs 177 of the rim member 173 brushes away the dust or dirt accumulated in the filter surface 126*a* while coming in contact with the filter surface 126*a* of the pleated annular filter 126, as explained with reference to FIGS. 6A through 7.

At this time, the multi-rim member 211 fixed on the lower part of the supporting axis 176 is rotated along with the supporting axis 176. Accordingly, as illustrated in FIG. 5B, the brush 215 of the multi-rim member 211 comes in contact with the upper surface of the partition plate 131 thus to brush away the dust or dirt accumulated on the upper surface of the partition 131 and to introduce the brushed-away dust or dirt into the dust discharging openings 134. The dust or dirt introduced into the dust discharging openings 134 is stored in the second dust collecting chambers 163.

As apparent from the foregoing description, according to the exemplary embodiment of the present disclosure, the cyclone dust-separating apparatus has the cleaning unit capable of automatically cleaning the dust or dirt accumulated in the filter unit. Accordingly, there is no need for the user to carry out the troublesome task of disassembling the cyclone dust-separating apparatus to clean the filter unit on occasion.

Further, the cyclone dust-separating apparatus according to the exemplary embodiment of the present disclosure drives the cleaning unit by using the second external air. Accordingly, there is no need for a separate motor for driving the cleaning unit, thereby allowing the fabrication costs to reduce.

Also, the cyclone dust-separating apparatus according to the exemplary embodiment of the present disclosure is configured, so that in the filter cleaning mode, the cleaning unit closes the air passage that the first external air drawn in through the suction nozzle is moved via the cyclone unit and the filter unit. Accordingly, the filter cleaning efficiency is improved.

Although representative embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A cyclone dust-separating apparatus of a vacuum cleaner comprising:

a cyclone unit having a cyclone chamber to whirl first air drawn in from outside thus to separate first dust or dirt therefrom;

a filter unit disposed in a filtering chamber located downstream of the cyclone unit and having a filter to filter second dust or dirt from the first air;

a cleaning unit to brush away the second dust or dirt accumulated in the filter by using second air drawn in from the outside; and a dust collecting unit to collect and store the first dust or dirt separated from the first air by the cyclone chamber and the second dust or dirt brushed away from the filter by the cleaning unit, wherein the cleaning unit comprises:

a filter brushing part to brush away the second dust or dirt from the filter;

a driving part to drive the filter brushing part by the second air; and an air passage changing part to change an air passage to allow the second air to drive the driving part in a filter cleaning mode, and wherein the filter brushing part comprises:

a rim member having at least one spoke, supported on a supporting axis rotatably installed in a supporting sleeve around which the filter is fixed; and a plurality of ribs movably and elastically supported on the rim member to come in contact with the filter thus to brush away the second dust or dirt from the filter when the rim member is rotated.

2. The apparatus as claimed in claim 1, wherein the filter comprises a pleated annular filter.

3. The apparatus as claimed in claim 1, wherein the cyclone dust-separating apparatus has a filter cleaning mode, and wherein in the filter cleaning mode, the cleaning unit is configured to close an air passage that the first air drawn in through a suction nozzle of the vacuum cleaner moves via the cyclone unit and the filter unit.

4. The apparatus as claimed in claim 1, wherein the driving part comprises:

at least one fan disposed to be rotated by the second air;

a worm formed on an axis of the at least one fan; and a worm gear formed on the supporting axis to engage with the worm.

5. The apparatus as claimed in claim 4, wherein the air passage changing part comprises an air passage changing valve, wherein the air passage changing valve is disposed among a cover, an air discharging guide to discharge the first air past the filter unit and an outflow pipe to discharge the first air to the outside from the air discharging guide, and wherein the cover is disposed over the filter unit and has at least one air inlet for drawing in the second air.

6. The apparatus as claimed in claim 5, wherein the air passage changing valve comprises:

an outer body extending to a bottom surface of the air discharging guide through a penetrated opening of an upper surface of the air discharging guide from the cover, and comprising an upper part having first and second upper openings formed to oppose each other and to be perpendicular to an air flowing direction, and a lower part having first and second lower openings formed to oppose to each other in the air flowing direction;

an inner body rotatably inserted in the outer body, and comprising an upper part having first and second upper openings formed to oppose to each other, and a lower part having first and second lower openings formed to oppose to each other and a third lower opening located in a position apart from the first or the second lower opening by an angle of 90 degrees; and a knob formed on the inner body to rotate the inner body.

7. The apparatus as claimed in claim 1, wherein the dust collecting unit comprises:

a first dust collecting chamber disposed around the cyclone chamber to collect and store the first dust or dirt separated from the first air by the cyclone chamber; and a plurality of second dust collecting chambers to collect and store the second dust or dirt brushed away from the filter.

8. The apparatus as claimed in claim 7, wherein the cleaning unit further comprises a dust discharge introducing part to introduce the second dust or dirt brushed away from the filter to move to the plurality of second dust collecting chambers without being adhered to the filter again.

9. The apparatus as claimed in claim 8, wherein the dust discharge introducing part comprises:

a multi-rim member having a plurality of spokes, fixed on the supporting axis; and a brush attached to the plurality of spokes of the multi-rim member to come in contact with a partition plate defining the filtering chamber thus to introduce the brushed-away second dust or dirt into the plurality of second dust collecting chambers.

* * * * *